US006244437B1

(12) United States Patent
Rogers

(10) Patent No.: US 6,244,437 B1
(45) Date of Patent: Jun. 12, 2001

(54) UNIVERSAL GOLF BAG PUTTER HOLDER

(76) Inventor: Thomas Lee Rogers, 1595 Rivergardens Dr., Bullhead City, AZ (US) 86442

( * ) Notice: Subject to any disclaimer, the term of this patent is extended or adjusted under 35 U.S.C. 154(b) by 0 days.

(21) Appl. No.: 09/602,635

(22) Filed: Jun. 22, 2000

(51) Int. Cl.[7] ..... A63B 55/00; A63B 55/02
(52) U.S. Cl. ..... 206/315.2; 206/315.4
(58) Field of Search ..... 260/315.2, 315.4

(56) References Cited

U.S. PATENT DOCUMENTS

| | | | | |
|---|---|---|---|---|
| 3,985,229 | | 10/1976 | Maki . | |
| 4,100,652 | | 7/1978 | Carlson . | |
| 4,932,523 | | 6/1990 | Yamazoe . | |
| 5,238,109 | * | 8/1993 | Smith | 206/315.2 |
| 5,299,611 | | 4/1994 | Cirone . | |
| 5,332,090 | | 7/1994 | Tuker . | |
| 5,730,285 | * | 3/1998 | Sheehan | 206/315.3 |
| 5,755,322 | * | 5/1998 | Yang | 206/315.2 |
| 5,816,396 | * | 10/1998 | Shin | 206/315.3 |
| 5,947,282 | * | 9/1999 | Merrill et al. | 206/315.6 |
| 5,988,378 | * | 11/1999 | Bell, Jr. | 206/315.2 |
| 6,085,901 | * | 7/2000 | Lin | 206/315.6 |
| 6,161,691 | * | 12/2000 | Ratcliff et al. | 206/315.2 |

* cited by examiner

*Primary Examiner*—Allan N. Shoap
*Assistant Examiner*—Tri M. Mai

(57) ABSTRACT

The object of this invention is to provide a golf bag putter holder that is convenient to use and protects, stores, aligns and segregates the putter and additionally is universal in it's application. A putter holder that under normal transportation and golf play, when attached to any conventional golf bag, will suspend a putter above a bag floor and secure all basic putter head designs firmly in place, whether a right or left handed putter or a short or long handled putter. A holder is disclosed comprised of a tube of resilient material for receiving the putter handle and shaft, with an adjustable clip integral to the tube for tube attachment to any conventional bags upper lip. The tubes top aperture is notched to seat club head in place. A plurality or uniquely shaped cushioning material surrounds the tube top aperture. A putter rests on a foundation of these materials in a manner that prevents contact with other stored clubs.

2 Claims, 2 Drawing Sheets

UNIVERSAL GOLF BAG PUTTER HOLDER

BACKGROUND OF THE INVENTION

This invention relates generally to a device which holds any basic type of golf club putter protectively in place within any type of conventional golf bag. More particularly, a holder that will accept all basic putter head designs with varying shaft lengths for any sized conventional golf bag of varying height.

The vast majority of golfers utilize a conventional golf bag that provides no damage protection for the stored club heads and little protection for the shaft and it's handle. Many conventional bags contain cross members near the bag opening to strengthen bag and to provide a method to partially segregate and arrange clubs. The woods are usually protected by the golfer with some form of cushioning material in the form of a sock. Most irons and the putter, however, are left to bunch together and as a result are subjected to damage caused by the inevitable vibration and jarring involved during golf play. The problem heretofore in protecting the putter, is caused by the wide range in diversity of designs for both bag and putter. Conventional golf bags come in varying heights, size and bag opening configurations. Most bags allow the club's handle to rest upon the bag floor which in turn can cause damage to a putter handle's butt end. While all putters have a flat surface for striking the ball, a connecting shaft and a slightly different handle, they are significantly different in their shaft lengths, thickness and configurations of putter heads in both the bladed and mallet form. Additionally, putters are manufactured in both right and left handed versions and come in slightly different "hozel" and shaft off-set designs.

A class of devises exist for protecting a set of golf clubs, that include the putter, that structurally attach to a conventional bag but do not provide the golfer the option of enhancing the storage capability of the putter alone. Prior art reveals several devices to improve upon storage of the putter. The most frequently used protective devise is a padded head cover which provides excellent protection but is inconvenient to use, has no other practical function and can be easily misplaced. Such head covers are not standardized in their application and do not lend themselves to placement of promotional advertisements. An example of a protective putter cover is disclosed in U.S. Pat. No. 5,299,611 issued to Cirone wherein elastic rubber material is enclosed around a putter head. Tucker, in U.S. Pat. No. 5,332,090 discloses a golf putter holder which clips on the upper lip of golf club bags that will secure a putter by it's shaft to the outer side of the bag. The primary purpose of this holder is to provide easy access and identification, and to keep the putter head segregated from damage. The disadvantage of this is that it defeats the purpose of a golf bag, exposing the putter to the elements when the bag is laid upon the ground, and has no other features to align, segregate or protect the putter when storage is required within the bag. A golf club anchor clips to the rim of a conventional bag in Carlson U.S. Pat. No. 4,100,652. It separates and holds a club in an erect position within a bag which would also align and enable arrangement of clubs but provide little protection for a putter head.

Yamazoe in U.S. Pat. No. 4,932,523 reveals a putter holder that is fitted by clip means to the inside structural cross members of a conventional golf bag. A putter shaft and handle is protected within a box-shaped tube and a putter head is provided protection by a frame and cover. While this holder provides alignment, segregation and arrangement for a putter, it has the disadvantage of being applicable to only those conventional bags that have cross members and those that have two cross members of the exact width as the holders clips. Additionally, this holder has the disadvantage of being usable only when the length of any given putter shaft is compatible to the height of any given bag.

Early prior art reveals bag length golf club tubes which are an elongated thin wall tubular plastic member opened at both ends that when inserted within a conventional bag provides the ability of a user to segregate clubs and protection for the shaft and handle. One of these tubes, is in fact a holder for the putter. The tubes, however provide no protection for the club heads and may contribute to added movement of a putter head caused by a swiveling movement around the tubes' outer top edge when the bag is in motion. Maki, in U.S. Pat. No. 3,985,229 discloses cap bodies to mechanically reinforce the top ends of tubes with rounded edges which may only contribute further to the swiveling motion since most putters, being the shortest club, most often rests on a tube top by its' head. Additionally, tubes provide no protection for a club handle butt end as the clubs' entire weight is upon a bag floor.

BRIEF SUMMARY OF THE INVENTION

A unique, novel and universally applied golf club putter holder is disclosed, which when attached to the upper lip of any conventional golf bag, will store and protect any basic putter while the bag is in motion during golf play and bag transportation. A clip for attachment to rim of a golf bag, a tube for storage and a padded putter head holding device are combined to create a lightweight, easily constructed and functional holder which can be positioned and repositioned anywhere around the rim of a bag. A putter is made to be suspended above the rim in a manner that provides quick access to the putter with multiple desirable features that will become obvious upon review of the drawings and detailed description. One of the primary objectives being to protect the face of a putter stored within a bag against damage and to improve upon the features and advantages of the prior art in a manner which does not have, or has to a substantially lesser degree, their disadvantages. Objectives include providing a putter holder that is convenient to use and which will accept, store, align, segregate and protect any basic putter, of any head design, whether made for a child or an adult, a right or left handed person, within any large or small sized conventional golf bag with any configured opening.

Further objectives are to provide putter protection by preventing the handle butt end from scraping against a bag floor and minimize shaft horizontal and rotational movement.

It's further objectives are to provide a putter holder that allows a putter to be highly visible while stored, and easily inserted and withdrawn without the necessity of removing or reattaching some form of a head covering element.

A further objective is to insure a putter head is protected from the elements when a bag is placed upon the ground. It is a further objective to provide a holder which allows an enhanced surface for placement of embroidered designs and advertisements, or the like thereon.

BRIEF DESCRIPTION OF THE DRAWINGS

The objects and features of the invention may be understood with reference to the following detailed description of an illustrative embodiment of the invention, taken together with the accompanying drawings in which.

DETAILED DESCRIPTION OF THE INVENTION

Figure 1:
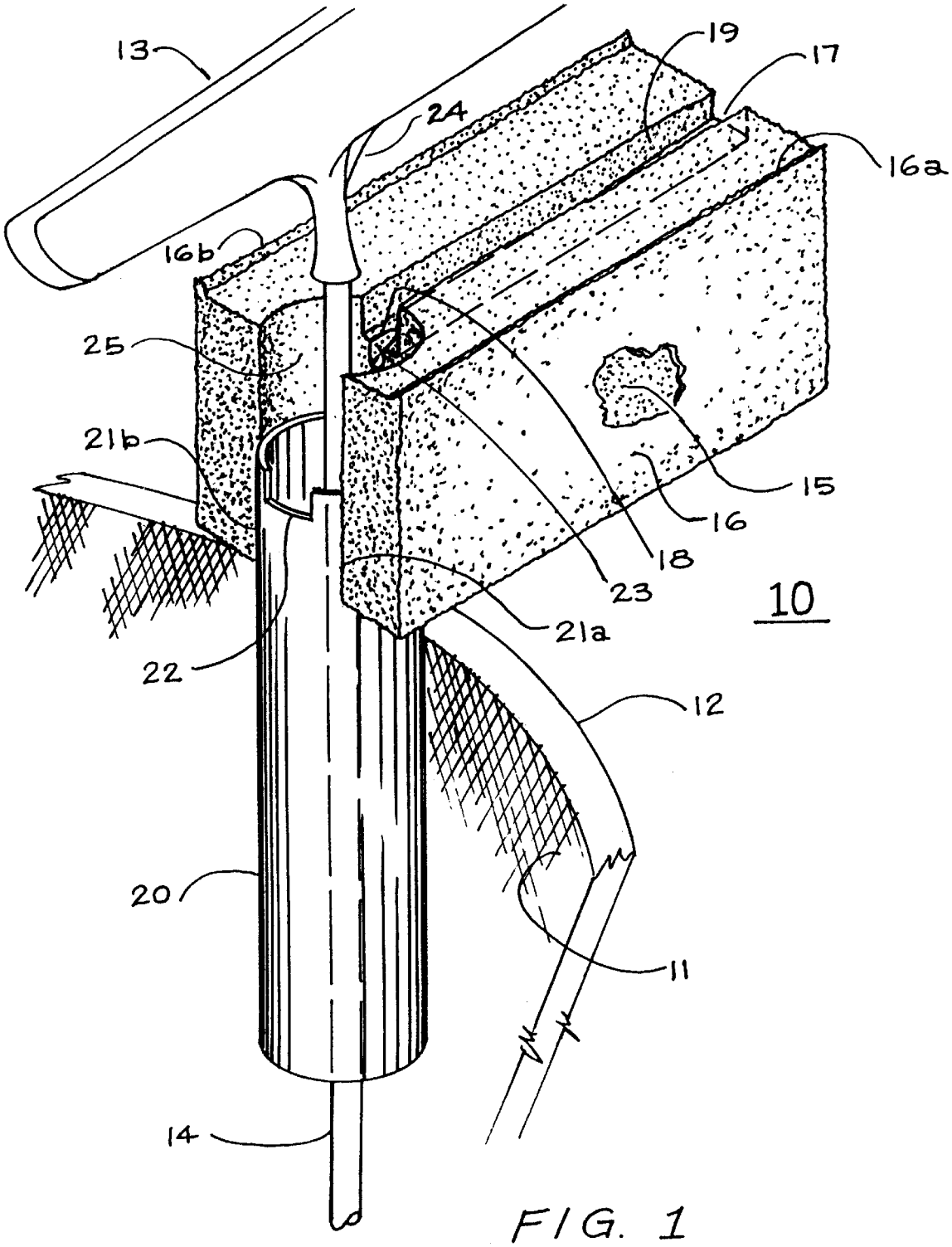
FIG. 1 is an isometric view of the putter holder placed upon a conventional golf bag viewed from inside a bag.
Figure 2:
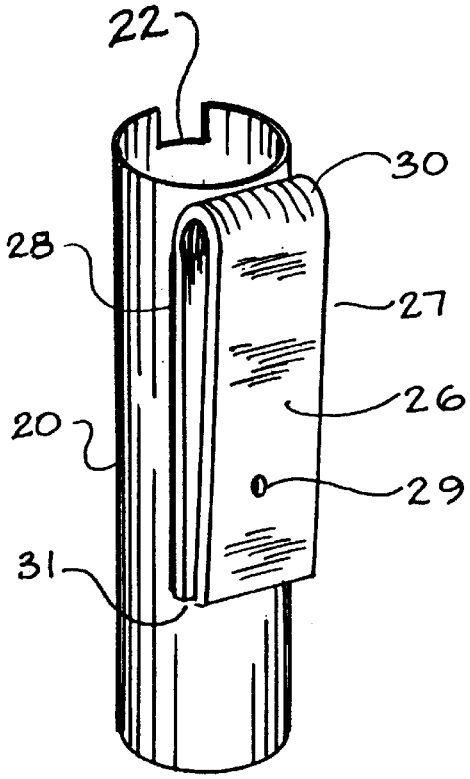
FIG. 2 is an isometric view of the tube and clip portion of the putter holder.
Figure 3:
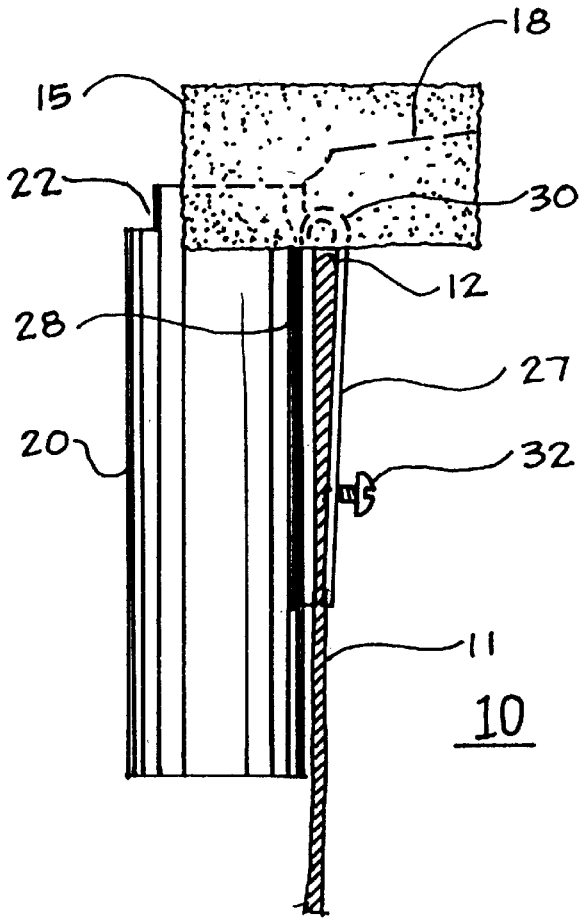
FIG. 3 is a side elevational view of the putter holder as attached to a conventional golf bag.

Turning now descriptively to the drawings, in which similar reference characters denote similar elements of the preferred embodiment throughout the several views. FIG. 1 shows the use of the putter holder 10 as attached to a conventional golf bag 11 above its' rim 12. A putter head 13 and its' putter shaft 14 are depicted just before becoming at rest upon and within putter holder 10. The putter holder 10 is attached to golf bag 11 by an adjustable clip best shown in FIG. 2 and FIG. 3. The putter holder 10 consists of a soft material 15, preferrably foam rubber or other suitable semi-soft synthetic material that is flexible in nature and capable of creating pressure against a putter head 13. Material 15 is covered in a relative mid-pile "fuzzy" nylon material 16 which provides means for longevity to the foam rubber, a pleasant look and assurance that good seating and padded protection of the putter head within its' resting slot 17 will occur. Slot 17 has a base 18 and opposing sidewalls 19 which are the approximate size of a conventional bladed putter head providing means for a squeezing effect upon a typical bladed putter head. Base 18 is sloped upward from an elongated tubular plastic tube 20, starting at a slightly higher elevation of the upper opening of tube 20 the same offset angle as exists in a typical putter between their shaft and head as best shown in FIG. 3. The tube 20 is open at both ends and is sized sufficiently to receive a putter shaft and its' handle. The tube is formed from a synthetic resin such as a polyolefin copolymer or propylene, etc., with a molded plastic adjustable clip made integral as best shown in FIG. 2. The foam material 15 is attached to tube 20 by use of a common suitable glue or cement at opposing tube surfaces at 21*a* and 21*b*.

FIG. 1 reveals that tube 20 contains a notch 22, approximately the size and width of a typical bladed putter head, at tube top opening to provide means to lock-in a putter head into holder 10 and prevent any swiveling effect upon a putter when a golf bag is in motion in conjunction with the pressures created by slot 19. To further assist in stabilizing a putter from movement, an indentation 23 in foam rubber 15 is created of approximately the same size and geometry of a putter hozel 24. To accommodate this indentation slot 17 is slightly elevated above the upper rim of tube 20. A cylindrical configuration 25 exists in the foam rubber 15 as a practical matter as well as to aid a user in removal of a putter. The size of the foam rubber 15 is a design choice but must be reasonably sufficient to protect a putter head from damage from another adjacent stored golf club. While the preferred embodiment of 15 is primarily rectangular it may be made in varied configurations including a more rounded shape and its' length and dimensions may be extended or shortened as well as the volume of material utilized. In the preferred design the nylon material 16 contains a lip at 16*a* and 16*b* on the two outer edges of the top portion of 10. A doubling over upon itself of said material creates a higher surface than 10 which in turn provides protection for unusual putter heads incuding the mallet type putter which may not reside entirely within slot 17.

Only two pieces of 16 material are necessary to cover the entire surfaces of 15 by one skilled in the art and be applied to 15 by common glue or cement. The two larger outside walls of 10 lend themselves to prominent display by embroidery of logos, designs and advertising. As shown in FIG. 2 an adjustable clip 26 is made integral to tube 20 by resin, glue, rivet or otherwise, preferrably by bonding process of like tube material. Tube 20 may be of any length compatible with clip 26 and short of conventional golf club bag floors. Tube 20 and its clip 26 provide the means by which holder 10 with a putter resting therein may be raised above rim of any conventional golf bag. In this way a putter handle butt end will be in suspension, will not be damaged by the scraping effect upon the bag floor and proper alignment within a golf bag of the putter shaft 14 will occur. Clip 26 has a member leg 27 which is angled inward to member leg 28. Leg 27 contains a threaded screw hole 29. The clip upper member portion 30 is curved and structurally thicker than its legs which provides the force and spring-like effect in such elastromer type flexible plastic clips. Leg 27 and 28 surfaces at lower end 31 are together and must be physically separated when 10 is being attached to a golf bag. Notch 22 is in opposing alignment with clip 26 and the uppermost portion of surface 30 residing level with tube 20 upper opening to reinforce and add structural integrity to generally fragile thin walled golf club tubes. Tube 20 and leg 28 are within a golf bag and leg 27 without as more clearly shown in FIG. 3. FIG. 3 illustrates putter holder 10 attached to a golf bag 11. A plastic screw 32 is depicted threaded through hole 29 of FIG. 2 and engaged against the outside surface of a bag with the holder 10 raised above rim 12 as may be preferred by a user depending upon users particular putter length and golf bag height. The clip is generally U-shaped with the upper curved portion 30 designed in a size to accommodate most common golf bag type lips 12. Leg 28 assures adhesion capability to tube 20 as well as structural integrity for leight-weight cloth based golf bags. Leg 27 is designed to press against the golf bag 11 outer surface and provide secondary stability to holder 10 in the event of screw 32 failure. The length of leg 27 and 28 are predetermined sufficiently to allow user adjustments that are inherent in both putter and golf bag length variants.

Although the present invention has described in detail with reference to certain preferred versions thereof, other versions are possible, including the obvious such as use of stitching to provide a more aesthetic look, clip rotation on tube, the addition of a covering flap or minimal changes to make holder accomodate an iron club or a particular putter head. Therefore, the spirit and scope of the appended claims should not necessarily be limited to the description of any preferred versions contained herein.

The embodiment of the invention in which an exclusive property or privilege is claimed are defined below:

1. A golf club putter holding device for attaching to a golf bag, said device comprising:

a) an elongated tube of a resilient thermoplastic material, first and second ends oppositely and longitudinally disposed on the tube, said first end being open and adapted for receiving a golf club putter shaft and handle, an opening notch formed in said first tube end and being sized to prevent a putter head when placed therein from substantial rotational movement, said second end being open to allow a putter shaft and handle to descend within a golf bag for vertical alignment with the bag inner sidewall;

b) a flexible clip attached to said tube, said clip comprising a U-shaped member having an inner leg and an outer leg spaced apart and interconnected by a curved portion, said curved portion located adjacent said first end, said legs extending downwardly along said tube, said outer leg having a threaded hole positioned near its lower end and having a screw located in said hole, said inner leg adhesively attached to said tube, said legs having substantially flat surfaces and being equal in length, said first leg being angled inward toward said second leg to produce a spring-like tension;

c) a cushioning member formed of foam rubber for contacting a putter head, said member being substantially rectangular in shape and presenting an upwardly facing top surface and opposing bottom surface, an elongated indentation through said top surface for gripping a portion of a head of a putter, said cushioning member having a circular cut-out adjacent an end of the member and extending from the bottom surface to the top surface and engaging said tube adjacent said first end, said indentation intersecting said cut-out, said notch and said indentation located on diametric opposing sides of said tube, said indentation and said notch cooperating so that when a portion of a putter head is located in said indentation, another portion of the putter head is located in said notch.

2. The golf club holding device of claim 1, said cushioning member having a soft material covering exposed surfaces of said cushioning member.

* * * * *